US007978152B2

(12) United States Patent
Huang

(10) Patent No.: US 7,978,152 B2
(45) Date of Patent: Jul. 12, 2011

(54) LED DISPLAY DEVICE FOR DISPLAYING PATTERN ON ROTATABLE OBJECT BY LIGHT-SCANNING

(76) Inventor: Wan-Hsiang Huang, Taipei (TW)

( * ) Notice: Subject to any disclaimer, the term of this patent is extended or adjusted under 35 U.S.C. 154(b) by 381 days.

(21) Appl. No.: 12/346,835

(22) Filed: Dec. 31, 2008

(65) Prior Publication Data

US 2010/0164841 A1 Jul. 1, 2010

(51) Int. Cl.
*G09G 3/00* (2006.01)

(52) U.S. Cl. ..... 345/31; 345/82; 340/463; 340/468; 362/35

(58) Field of Classification Search ..... 345/31
See application file for complete search history.

(56) References Cited

U.S. PATENT DOCUMENTS

| | | | | |
|---|---|---|---|---|
| 5,444,456 | A * | 8/1995 | Ohta et al. | 345/39 |
| 5,670,971 | A * | 9/1997 | Tokimoto et al. | 345/31 |
| 6,265,984 | B1 * | 7/2001 | Molinaroli | 340/815.4 |
| 6,278,419 | B1 * | 8/2001 | Malkin | 345/31 |
| 6,492,963 | B1 * | 12/2002 | Hoch | 345/39 |
| 6,936,980 | B2 * | 8/2005 | Wang | 315/292 |
| 7,079,042 | B2 * | 7/2006 | Reim | 340/815.45 |
| 7,161,256 | B2 * | 1/2007 | Fang | 290/1 R |
| 7,271,813 | B2 * | 9/2007 | Gilbert | 345/619 |
| 7,355,573 | B2 * | 4/2008 | Ogawa | 345/82 |
| 7,372,430 | B2 * | 5/2008 | Shinohara | 345/35 |
| 2002/0005826 | A1 * | 1/2002 | Pederson | 345/82 |
| 2004/0130905 | A1 * | 7/2004 | Olds et al. | 362/487 |
| 2006/0038831 | A1 * | 2/2006 | Gilbert | 345/619 |
| 2008/0068297 | A1 * | 3/2008 | Gilbert | 345/31 |
| 2010/0033945 | A1 * | 2/2010 | Huang | 362/35 |
| 2010/0156767 | A1 * | 6/2010 | Huang | 345/82 |

* cited by examiner

*Primary Examiner* — Richard Hjerpe
*Assistant Examiner* — Christopher Thompson

(57) ABSTRACT

An LED display device for displaying a pattern on a rotatable object by light-scanning; wherein when the rotating object rotates with a high speed, the pattern will display; the device comprising: a display device for displaying at least one pattern; the display device being fixed without rotation in operation; the display device including a screen, a processor and a memory; the processor serving to control displaying of patterns on the display device; the memory serving to store patterns to be displayed and other processing programs; a rotating printed circuit board having at least one bank of LEDs; a control circuit board controlling electric conduction of each LED; and an image scanner connected to the control circuit board; the image scanner can scan through the screen of the display device so as to sense the pattern on the screen.

9 Claims, 6 Drawing Sheets

LED DISPLAY DEVICE FOR DISPLAYING PATTERN ON ROTATABLE OBJECT BY LIGHT-SCANNING

FIELD OF THE INVENTION

The present invention relates to patterns display by using LEDs, and particularly to an LED display device for displaying a pattern on a rotatable object by using optical-scanning method, wherein a bank of light emitting diodes are arranged on a rotatable object. By the present invention, when the rotatable object rotates, by the affect of photogene, the light emitting diodes will display with a predetermined pattern which can be viewed clearly.

BACKGROUND OF THE INVENTION

There are many prior arts about the display of LED which are mainly used for indications, decorations and advertisements.

For example, in U.S. Pat. No. 7,036,959, a LED lampshade for advertisement brand and decoration is disclosed. The device comprises an LED lampshade for advertisement brand and decoration which comprises a deformable cover having two tenons at two ends; the cover being originally a flat shape; after assembly, the cover having a U shape; and a seat having two trenches positioned corresponding to the two tenons of the cover. The seat has a groove for locating an LED lamp. Two lower ends of the seat have the tenons, respectively. An upper side of each tenon has a stopper; and a transparent portion is formed on the cover. The groove is formed between the two trenches. Each trench has a corresponding elastomer aside the trench; each elastomer has a corresponding seat notch for receiving the elastomer as the elastomer is pressed downwards. In assembly, the two tenons of the cover are inserted into the trenches of the seat so that the cover is formed on the seat.

In another prior art, U.S. Pat. No. 6,910,788 A wheel light device for a vehicle with an electrical battery, in that, wheels, fenders and wheel wells that shines light onto and in front of one of each of the wheels of the vehicle. The device includes LED bulbs in a casing and a reflector that attaches to the bulbs to direct light onto the wheels of a vehicle. A waterseal canal, for draining any water and condensation that may accumulate within the wheel light device, and a waterproofing gasket, for sealing the device from any water reaching its components, protect the device from water. There are several different embodiments of the invention including an outer fender flare mounted embodiment with multiple LED bulbs, an inner fender mounted embodiment with multiple LED bulbs, provisions to address arched wheel wells or horizontally straight wheel wells, various safety light provisions in addition to additional supplemental features.

However in all prior arts, maybe the LEDs can provide the function of advertisement or display, but no prior art can provide the function for displaying a pattern on a rotating wheel with clear vision so as to have the function of advertisement. This is because the wheel is a rotating unit which will cause the image to rotate therewith so that the pattern thereon will become vague. As a result the viewer can not see the advertising pattern clearly even the viewer can not see what displayed on the wheel.

SUMMARY OF THE INVENTION

Accordingly, the object of the present invention is to provide an LED display device for displaying a pattern on a rotatable object, wherein a bank of light emitting diodes are arranged on a rotatable object. By the present invention, when the rotatable object rotates, by the affect of photogene, the light emitting diodes will display a predetermined pattern which can be viewed clearly so as to achieve the object of alerting the pattern to people. The present invention is especially suitable for wheels. Rotation of the wheel will cause the pattern to be displayed with a flash affect which cannot achieve by other prior art.

To achieve above object, the present invention provides an LED display device for displaying a pattern on a rotatable object by light-scanning; wherein when the rotating object rotates with a high speed, the pattern will display; the device comprising: a display device for displaying at least one pattern; the display device 1 being fixed without rotation in operation; the display screen being connected to one end of a power wire 11; the display screen including a screen, a processor and a memory; the processor serving to control displaying of patterns on the display device; the memory 12 serving to store patterns to be displayed and other processing programs; a rotating printed circuit board having at least one bank of LEDs; the rotating printed circuit board being arranged on one side of a rotating body so that the rotating printed circuit board can be viewed easily; a control circuit board controlling electric conduction of each LED; the control circuit board having a switch bank; the switch bank 31 including a plurality of switches; the switching operation of the switch bank being controlled by the control circuit board; each LED being connected to a conductive wire which is connected to one end of a corresponding switch; and another end of the switch being connected to a power source for supplying power to the LED to light up; and an image scanner connected to the control circuit board; the image scanner including a plurality of light sensors and a photoelectric converter; the photoelectric converter serving for converting sensed light into electric current; the image scanner can scan through the screen of the display device so as to sense the pattern on the screen; then sensed light signals being converted into electric signals and then the electric signals being transferred to the control circuit board; wherein the rotating printed circuit board, the control circuit board and the image scanner are arranged on the rotating body so as to rotate with the rotating body.

The various objects and advantages of the present invention will be more readily understood from the following detailed description when read in conjunction with the appended drawing.

DETAILED DESCRIPTION OF THE INVENTION

Figure 1:
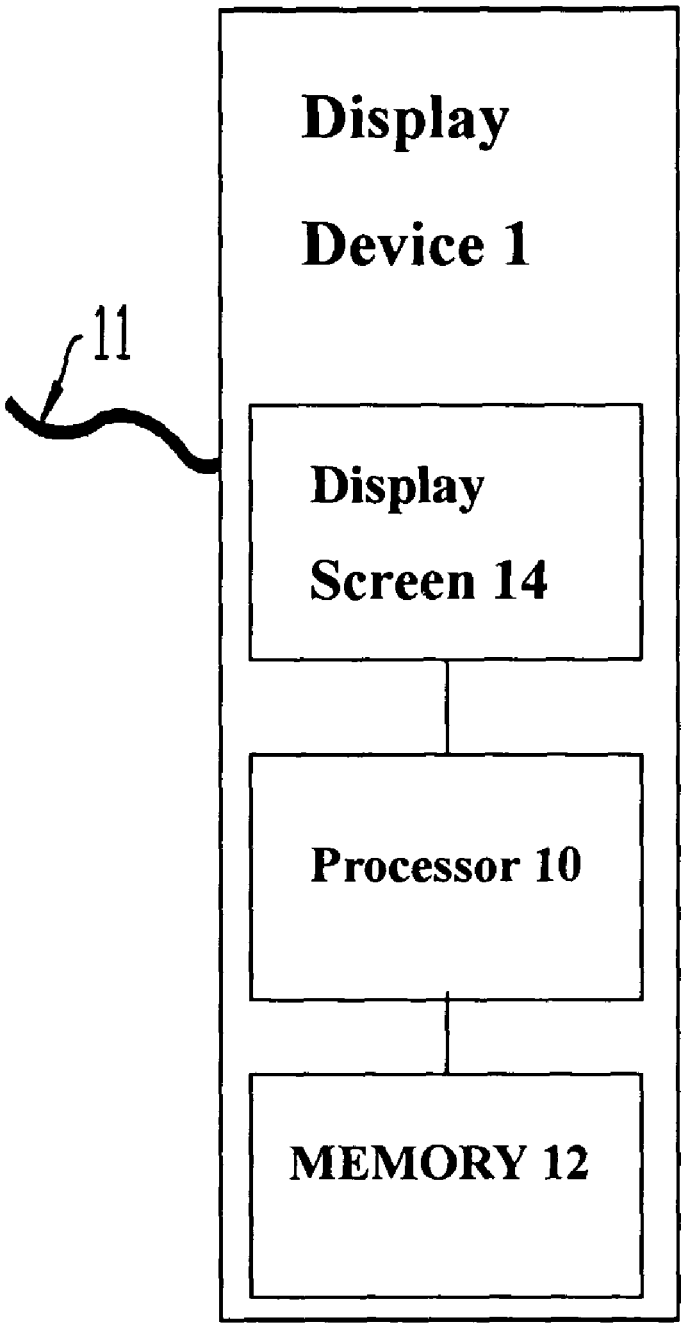
FIG. 1 is a block diagram about the elements of the display device of the present invention.
Figure 2A:
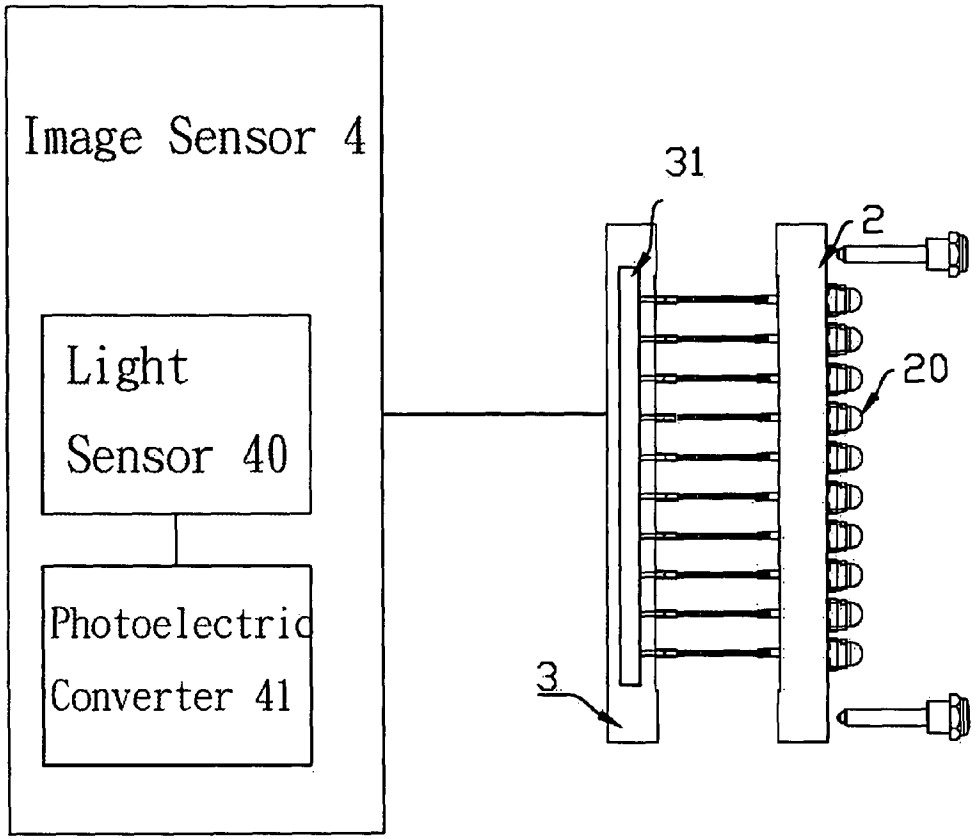
FIG. 2A is a schematic view showing the structure of the present invention.
Figure 2B:
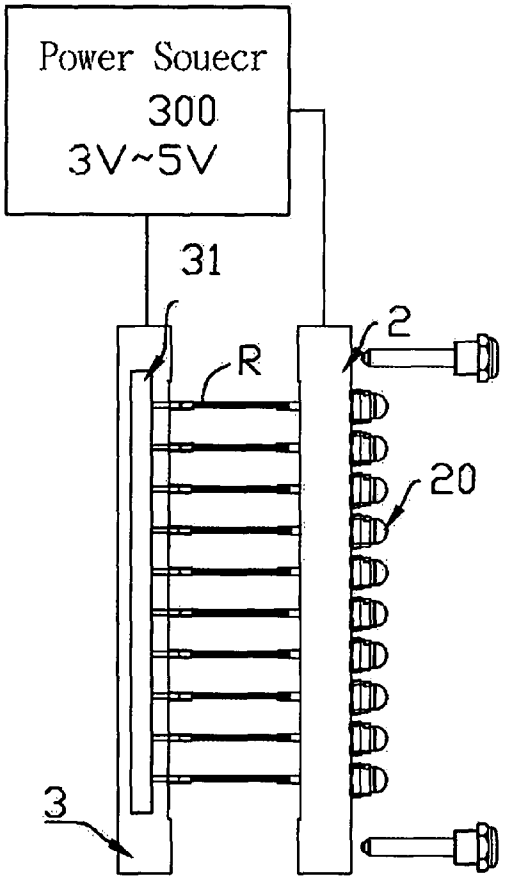
FIG. 2B shows a circuit diagram about the rotating printed circuit board, control circuit board and power source of the present invention.
Figure 3:
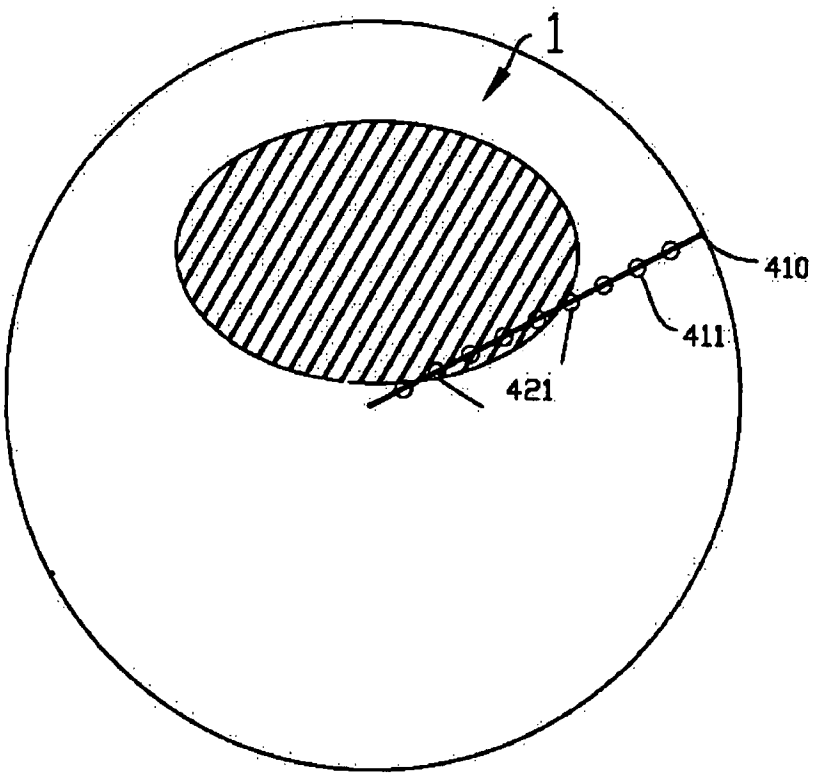
FIG. 3 is a schematic view showing the operation of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1(A) to 5, the present invention relates to a pattern display device by LEDs on a rotating object and by using optical scanning method. A bank of LEDs are arranged on a rotatable object. When the rotatable object rotates with high speeds, a pattern (may be texts or figures) is displayed by the LEDs. The present invention has improved the defect in the prior art. In the prior art, the pattern on a high speed rotatable object can not be clearly identified. The structure of the present invention will be described in detail in the following.

A display device 1 serves for displaying at least one pattern which may be textures or drawings. The display device 1 is fixed without rotation in operation. The display device 1 is connected to one end of a power wire 11. Another end of the power wire 111 may be connected to a battery set of a car as a power source. The display device 1 includes a screen 14, a processor 10 and a memory 12; the processor 10 serving for controlling displaying of the pattern on the display screen. The memory 12 serves to store patterns to be displayed and other processing programs.

The display device 1 is arranged at a hidden side of a rotating body so that people do not view the display device 1.

A rotating printed circuit board 2 has a bank of LEDs (light emitting diodes 20). Two polarities of each LED have a voltage difference of about 3V to 5V. The current limiting resistor is added to each of the LED. The rotating printed circuit board 2 is arranged on one side of a rotating body so that the rotating printed circuit board 2 can be viewed easily.

A control circuit board 3 serves to control current conduction of each LED. The control circuit board 3 has a switch bank 31. The switch bank 31 includes a plurality of switches. The switching operation of the switch bank 31 is controlled by the control circuit board 3. Each LED has a conductive wire R which is connected to one end of a corresponding switch. Another end of the switch is connected to a power source 300 for supplying power to the LED to light up.

An image scanner 4 is connected to the control circuit board 3. The image scanner 4 includes a plurality of light sensors 40 and a photoelectric converter 41. The photoelectric converter 41 serves to convert light energy into electric current. The image scanner 4 can scan through the screen 14 of the display device 1 so as to sense the pattern on the screen 14. Then sensed light signals are converted into electric signals and then the electric signals are transferred to the control circuit board 3.

The rotating printed circuit board 2 and the control circuit board 3 are arranged on the rotating body so as to rotate with the rotating body.

The present invention can be used to various rotating objects. In the following, a wheel of a car is used as an example for describing the operation of the present invention.

The display device 1 is fixed to a car and is located at an inner side of the wheel. The rotating printed circuit board 2, the control circuit board 3 and the image scanner 4 are attached to the wheel. The display device 1 will not rotate with the wheel. The rotating printed circuit board 2, control circuit board 3 and the image scanner 4 rotate with the wheel. The image scanner 4 is arranged at a position corresponding to the screen 14 of the display device 1 so that the image scanner 4 will sense the illumination of the screen 14 of the display device 1 as the wheel rotate. A scanning line 410 projected from the light sensor 40 is projected upon the screen 14 of the display device 1. Only a part 421 of the light sensor 40 will sense reflecting light from the pattern on the screen 14. The part is a part within the coverage of the pattern. Light sensed in the part 421 of in the light sensors 40 will be converted into electric currents by using the photoelectric converter 41 of the image scanner 4. Then the currents are transferred to the control circuit board 3 to control turn on and off operation of the switches of the switch bank 31. Each switch serves to control the turning on and turning off of a corresponding to LED. Each LED has the conductive wire R which is connected to a corresponding switch and then to the power source 300 and a current limiting resistor is connected serially to the conductive wire so as to form as a loop. Thus, LEDs corresponding to the light sensors 41 sensing the reflecting light from the screen 14 of the display device 1 will light up. As the wheel rotates with high speed, the pattern will display with the rotation of the wheel. In the present invention, the display device 1 is preferably a liquid crystal display.

Advantages of the present invention are that any pattern can be recorded to the memory so that various patterns can be displayed on the screen 14 of the display device 1 and thus the rotating printed circuit board 2 can display different pattern. For the case of cars, the rotating printed circuit board 2 can display different trademark of a car manufacturers.

As the wheel rotates with a high speed, the printed circuit boards will rotate with the wheel. Due to the effect of photogene, when the wheel rotates through an angle, the LEDs will light up according to the contact result that the elastic sheets 20 contact the pattern 30 on the third printed circuit board 3 so as to present a continuous pattern as a whole frame.

In the following, we will explain the principle about this phenomenon by an example. For example a car runs with a speed of 60 kilometer per hour with wheels having a diameter of 33 centimeters. The pattern in the third printed circuit board is desired to cover an angle range of 120 degrees. Thus, the speed can be converted into meters per second by the operation that 60 (km/hr)×1000 (m/km)×1/3600 (hr/s) =16.6666 (m/s). A periphery of the wheel is $2\pi R=2\times3.14\times0.33$ m=2.07 m. Thus the wheel rotates through 16.6666÷2.07=8 circle per second. That is, the wheel needs 0.125 second for rotating through one circle. If the pattern occupies 120 degrees (⅓ circle), the time showing the pattern as the wheel rotates through one circle is 0.0417 second. However in this short time period, human eyes will feel that the area sweeping through by the light emitting diodes is a continuous pattern as the pattern 30 on the third printed circuit board 3.

Furthermore, as we known the response time for the light emitting diodes to light up as a current to flow thereto is about 80 nanoseconds (ns), which is very short as comparing with the 0.0417 second per circle. Thus it can assure that the displayed pattern on the wheel has a sufficient resolution to make people view the pattern clearly.

For the speed of 60 km/h, it is 60 (km/hr)×1000000 (mm/km)×1/3600 (hr/s)=1666.6666 (mm/s). Thus the displacement is 1666.6666 (m/s)×80×10−9S=0.0013333 mm. It supports that the light emitting diodes can respond the contact result real time.

Figure 4A:
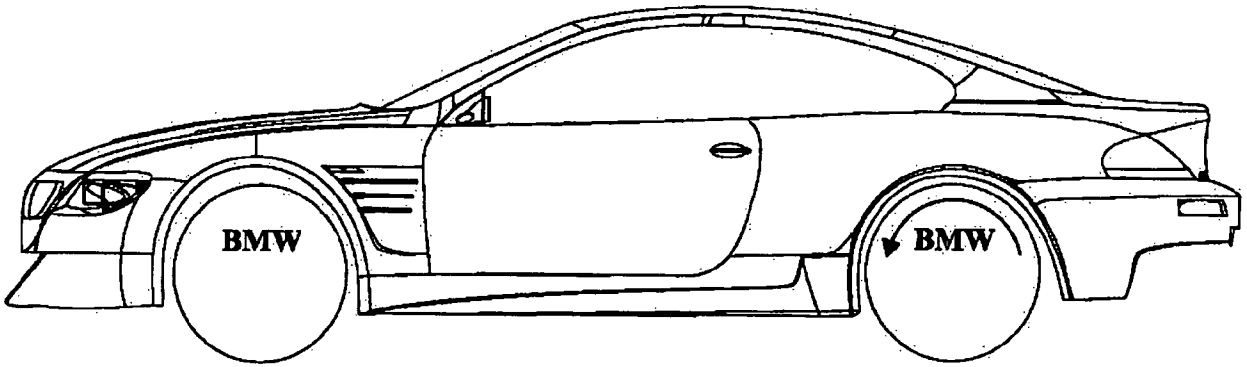
FIGS. 4A and 4B show the applications of the present invention.
Figure 4B:
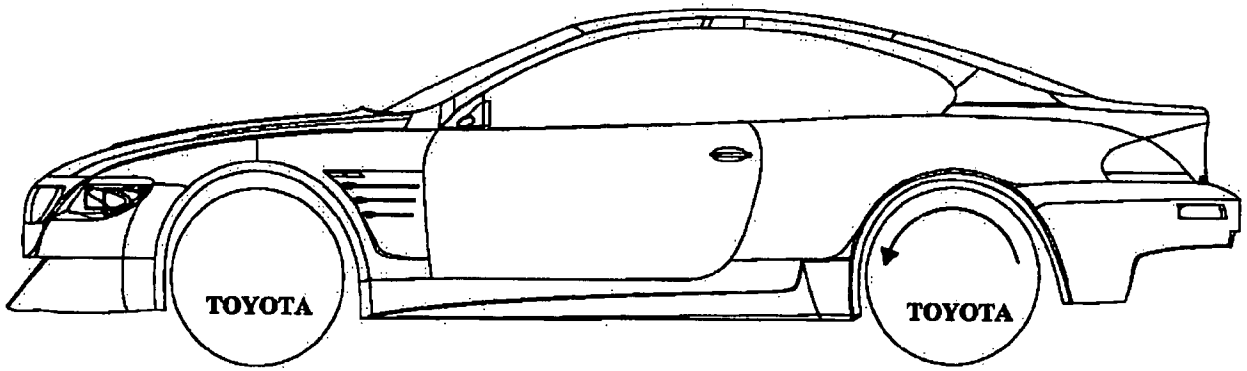
Figure 5A:
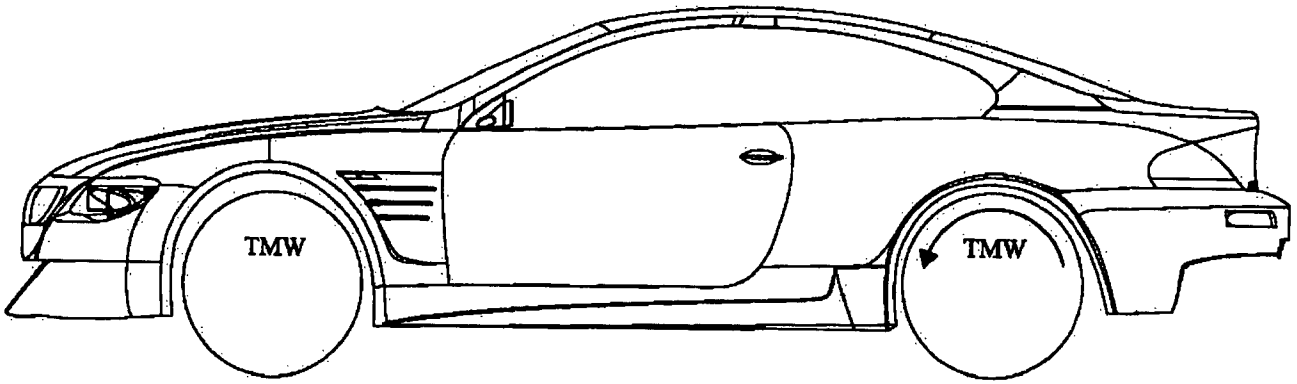
FIGS. 5A and 5B shows another application of the present invention.
Figure 5B:
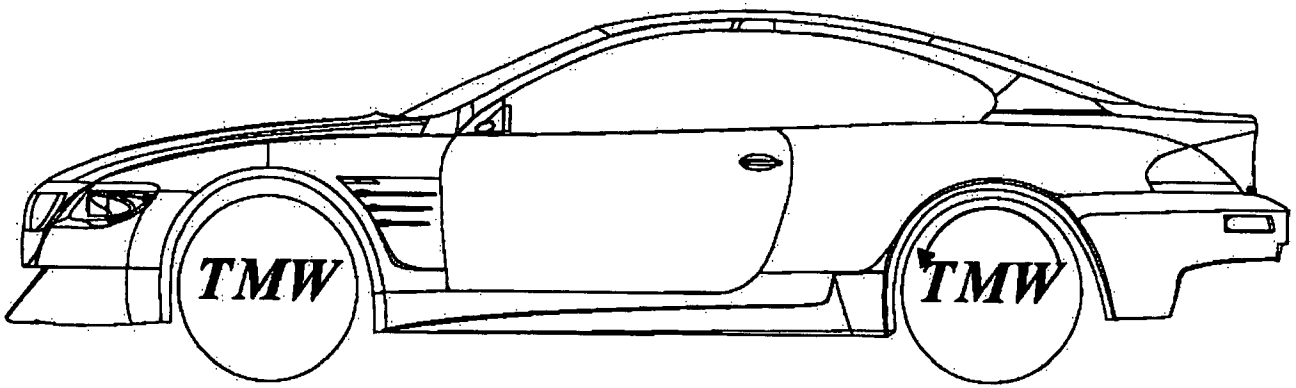

As illustrated in FIGS. 4(A) to 4(B), the preferred embodiment of the present invention is that the present invention is used to tires of vehicles for advertisement, for example to display the LOGO of the manufacturers of the vehicles, such as BMW, BENZ, TOYOTA, etc. Referring to FIGS. 5(A) and 5(B), it is illustrated that in the present invention, by controlling the size of the pattern on the screen 14 of the display device 1, the size of the pattern displaying on a wheel is controllable to have different sizes.

In the present invention, the first printed circuit board 1 on the rotatable object rotates with the rotatable object. The light emitting diodes may be arranged as a bank, a half bank, a plurality of banks.

In the present invention, each light emitting diode may be formed by a plurality of LED sets. Each LED set includes a plurality of LED of different colors. Such as each LED set includes three LEDs, which a red LED, a green LED and a blue LED so as to present various colors as desired by corresponding wiring methods. Generally, the lifetime of an LED may be over 100,000 hours which is sufficient for use.

The present invention can be used to other rotating object, such as windmills, motorcycles, fans, rotatable advertisement boards, propellers of planes or helicopters; etc.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An LED display device for displaying a pattern on a rotatable object by light-scanning; wherein when the rotating object rotates with a high speed, the pattern will display; the device comprising:

a display device for displaying at least one pattern; the display device being fixed without rotation in operation; the display screen being connected to one end of a power wire; the display device including a display screen, a processor and a memory; the processor serving to control displaying of patterns on the display device; the memory serving to store patterns to be displayed and other processing programs;

a rotating printed circuit board having at least one bank of LEDs; the rotating printed circuit board being arranged on one side of a rotating body so that the rotating printed circuit board can be viewed easily;

a control circuit board controlling electric conduction of each LED; the control circuit board having a switch bank; the switch bank including a plurality of switches; the switching operation of the switch bank being controlled by the control circuit board; each LED being connected to a conductive wire which is connected to one end of a corresponding switch; and another end of the switch being connected to a power source for supplying power to the LED to light up; and an image scanner connected to the control circuit board; the image scanner including a plurality of light sensors and a photoelectric converter; the photoelectric converter serving for converting sensed light into electric current; the image scanner can scan through the display screen of the display device so as to sense the pattern on the screen; then sensed light signals being converted into electric signals and then the electric signals being transferred to the control circuit board; and wherein the rotating printed circuit board, the control circuit board and the image scanner are arranged on the rotating body so as to rotate with the rotating body.

2. The LED display device for displaying a pattern on a rotatable object by light-scanning as claimed in claim 1, wherein another end of the power wire is connected to a battery set of a car as a power source.

3. The LED display device for displaying a pattern on a rotatable object by light-scanning as claimed in claim 1, wherein two polarities of each LED have a voltage difference of about 3V to 5V and a current limiting resistor is serially connected to each of the LEDs.

4. The LED display device for displaying a pattern on a rotatable object by light-scanning as claimed in claim 1, wherein the display device is arranged at a hidden side of a rotating body so that people do not view the display device.

5. The LED display device for displaying a pattern on a rotatable object by light-scanning as claimed in claim 1, wherein the pattern is selected from at least one of textures and drawings.

6. The LED display device for displaying a pattern on a rotatable object by light-scanning as claimed in claim 1, wherein the pattern is a LOGO for vehicle manufacturers.

7. The LED display device for displaying a pattern on a rotatable object by light-scanning as claimed in claim 1, wherein the light emitting diodes are arranged as a bank or a plurality of banks according to the rotation speed of the rotatable object.

8. The LED display device for displaying a pattern on a rotatable object by light-scanning as claimed in claim 1, wherein the rotatable object is selected from windmills, vehicles, electric fans, propellers of planes and helicopters, and advertisement boards.

9. The LED display device for displaying a pattern on a rotatable object by light-scanning as claimed in claim 1, wherein the display is a liquid crystal display.

* * * * *